US006085738A

United States Patent [19]

Robinson et al.

[11] Patent Number: 6,085,738

[45] Date of Patent: Jul. 11, 2000

[54] MULTI-FUEL BURNER AND HEAT EXCHANGER

[75] Inventors: Edgar C. Robinson, Vancouver; Leonard Fleming, Delta; Daniel M. Fraser, Surrey, all of Canada

[73] Assignee: International Thermal Investments Ltd., Richmond, Canada

[21] Appl. No.: 08/394,012

[22] Filed: Feb. 21, 1995

Related U.S. Application Data

[63] Continuation-in-part of application No. 08/089,763, Jul. 9, 1993, Pat. No. 5,391,075.

[51] Int. Cl.[7] ..... F24C 1/08; A47J 27/00

[52] U.S. Cl. ..... 126/75; 126/31; 126/110 R; 126/350 R; 126/391; 126/390; 126/392; 126/378

[58] Field of Search ..... 126/75, 51, 30, 126/31, 29, 78, 73, 378, 116, 110 R, 350 R, 391, 392, 390; 317/98

[56] References Cited

U.S. PATENT DOCUMENTS

| | | | |
|---|---|---|---|
| Re. 28,679 | 1/1976 | Robinson | 431/9 |
| 3,823,704 | 7/1974 | Daugirda et al. | 126/392 |
| 3,875,477 | 4/1975 | Fredriksson et al. | 317/98 |
| 3,947,218 | 3/1976 | Landis | 431/79 |
| 4,137,035 | 1/1979 | Cade | 431/51 X |
| 4,243,372 | 1/1981 | Cade | 431/78 X |
| 4,651,714 | 3/1987 | Granberg | 126/378 |
| 4,869,230 | 9/1989 | Fletcher et al. | 126/91 A |
| 4,875,465 | 10/1989 | Kramer | 126/391 |
| 4,955,359 | 9/1990 | Briggs et al. | 126/110 R |
| 4,971,027 | 11/1990 | Krieger | 126/390 X |
| 5,102,328 | 4/1992 | Robinson | 431/116 |
| 5,207,212 | 5/1993 | Woollen, Jr. | 126/391 |
| 5,586,547 | 12/1996 | Nixon | 126/391 |

OTHER PUBLICATIONS

Advertising brochure of the Norton Company entitled "Norton Hot Surface Igniters"; date unknown.

*Primary Examiner*—Ira S. Lazarus
*Assistant Examiner*—David Lee
*Attorney, Agent, or Firm*—John Russell Uren

[57] ABSTRACT

A burner has a burner tube and a nozzle holder mounted in one end of the burner tube. An igniter is positioned within the nozzle holder and acts to ignite any of the multi-liquid fuels which may be used with the burner. A nozzle emits atomized liquid fuel under the venturi effect of the nozzle with compressed air being supplied to the nozzle. Primary air holes extend circumferentially around the nozzle holder to admit air radially which passes directly to the burner tube. Secondary air holes extend around the inside circumference of the burner tube on the secondary air injection plate and admit air axially to the burner tube.

9 Claims, 9 Drawing Sheets

LOW SIDE SENSOR

HIGH SIDE SENSOR

MULTI-FUEL BURNER AND HEAT EXCHANGER

CROSS-REFERENCED TO RELATED APPLICATIONS

This is a continuation-in-part of U.S. application Ser. No. 08/089,763 filed Jul. 9, 1993, now issued as U.S. Pat. No. 5,391,075, dated Feb. 21, 1995 and entitled MULTI-FUEL BURNER.

INTRODUCTION

This invention relates to a multi-fuel burner and, more particularly, to a multi-liquid fuel burner utilizing an igniter and a nozzle holder which emits atomized fuel.

BACKGROUND OF THE INVENTION

It is desirable in many applications to have a burner which will operate using a plurality of fuels. Such a burner is described and claimed in Reissue U.S. Pat. No. 28,679 naming the same inventor as named in the present application. The use of a multi-fuel burner is desirable because it may be operated with fuel as is readily available in the operating environment where the burner is utilized. For example, in the high north, construction and mining equipment may operate with diesel fuel. It is convenient to use such a fuel for operating the burner.

The burner illustrated and disclosed in Reissue Pat. No. 28,679 and in U.S. Pat. No. 5,102,328, however, utilize in the first instance a round flame grid and, in the second instance, a cylindrical flame grid which are convenient for the particular applications under which they may be used. In other applications, however, it is convenient to utilize a flame grid having a different configuration which may be designed and manufactured for far less expense and which may be used, for example, for water heating and for oven heating, which oven may be used in a field kitchen by the military. A furnace may also utilize the burner which furnace distributes the hot air by using appropriate ducting.

Heretofore, the multi-fuel burner according to the aforementioned patents has used an ignition electrode to provide for the initial combustion of the atomized liquid fuel which is emitted from the nozzle by the venturi action of the primary air in the nozzle. Ignition electrodes, however, have a gap in which the distance is critical. The tips of such electrodes can also burn off until the electrode eventually becomes inoperable and a relatively high amount of power is required to form the spark on the electrode. Thus, relatively high maintenance is required to keep the ignition electrode in optimum condition and replacement is, of course, required from time to time.

Although igniters have been used with gaseous systems such as propane as described in U.S. Pat. No. 3,875,477, it has not been contemplated that an igniter may be used with atomized liquid fuels. Although propane is stored in a liquid form, when the pressure is released on the liquid, the propane is ejected by the nozzle in gaseous form. The propane will be ignited when it passes over the igniter.

The place of introduction of secondary air is important. For example, if it is desired that combustion occur on an external grid rather than internally of the burner tube, the secondary air is added at a location where it supports combustion on the grid and not within the burner tube.

SUMMARY OF THE INVENTION

According to one aspect of the invention, there is provided a burner having an air aspirated nozzle, a compressor for supplying compressed air to said air aspirated nozzle, a fuel supply for supplying fuel to said air aspirated nozzle, a regulator for regulating the amount of fuel provided to said air aspirated nozzle, and a heat exchanger surrounding said burner, said heat exchanger having a plurality of flutes surrounding said burner, said flutes having an inside and outside surface area, a water supply to supply water to said heat exchanger, said inside area of said flutes being exposed to the heat produced by said burner and said outside area of said flutes being exposed to the water circulated through said heat exchanger.

According to a further aspect of the invention, there is provided a flame flickering monitor to monitor the flickering of a flame in a burner, said flame flickering monitor having a circuit associated therewith to substantially remove the DC component of a signal produced by said flame flickering monitor and to measure the AC signal produced by said flame flickering monitor, said circuit further being operable to terminate operation of said burner when said AC signal drops below a predetermined level.

BRIEF DESCRIPTION OF THE SEVERAL VIEWS OF THE DRAWINGS

Specific embodiments of the invention will now be described by example only, with the use of drawings in which.

DESCRIPTION OF SPECIFIC EMBODIMENT

Figure 1:
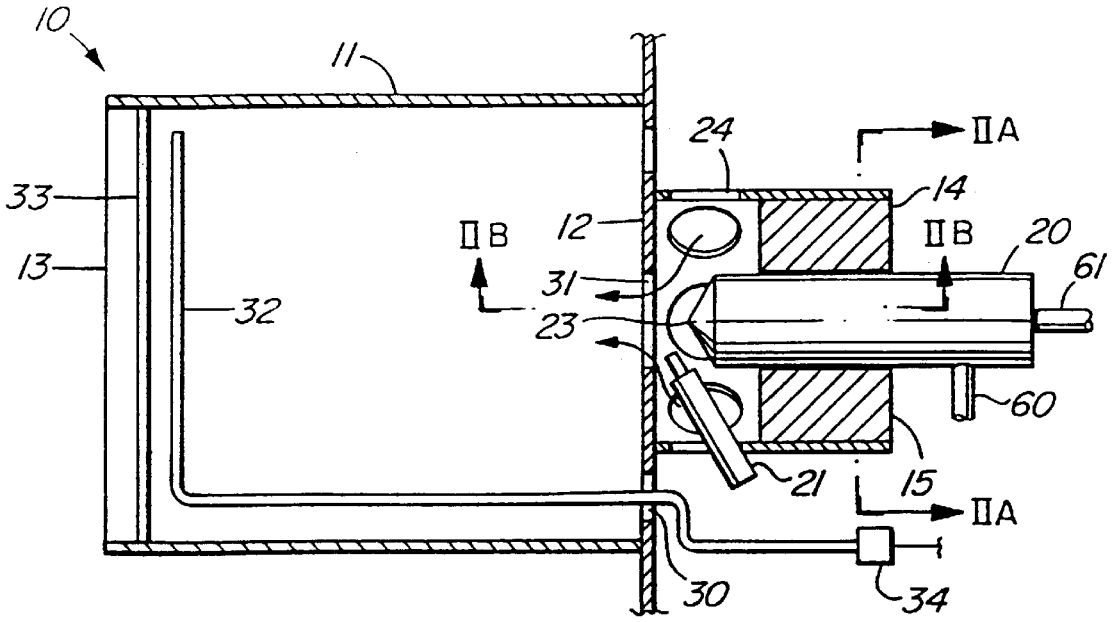
FIG. 1 illustrates a burner according to the invention having a burner tube in which combustion takes place with a nozzle holder connected to the end of the burner tube in accordance with the present invention.

Referring now to the drawings, a burner according to the invention is generally illustrated at 10 in FIG. 1. It comprises a burner tube 11 with one end having a closed secondary air injection plate 12. The opposite end 13 of the burner tube 11 is open.

The secondary air injection plate 12 is operably connected to a nozzle holder 14. Nozzle holder 14 is adapted to allow the mounting of a nozzle 20 in one end 15 of the nozzle holder 14 and also to allow an igniter 21 to be mounted on an inclined radial to the nozzle holder 14 as is illustrated. A typical igniter that may be utilized in this application is a NORTON hot surface igniter and, in particular, the NORTON Model 301 igniter. The igniter 21 has a tip 22 which is located a distance from the apex 23 of the nozzle 20 such that when atomized liquid is emitted from the nozzle 20, the tip 22, when heated, allows the atomized fuel to be ignited as will be described.

A plurality of circumferential holes 24, conveniently eight (8) in number, are located about the periphery of the nozzle holder 14 and allow primary air to enter the nozzle holder 14 and to proceed directly, without diversion, to the burner tube 11 as is indicated by the arrows.

A plurality of circumferential secondary air holes 30 are located about the inside circumference of the burner tube 11 and are drilled through the secondary air injection plate 12 in the positions illustrated. A central circumferential aperture 31 allows ingress of the atomized fuel from the nozzle 20 into the burner tube 11 where combustion occurs.

A flame rod 32 is located in the burner tube 11 and is operable to pass current between the flame rod 32 and ground 33 operably mounted across the burner tube 11 so as to indicate the presence or absence of a flame. A voltage source 34 supplies the necessary power to the flame rod 32.

Nozzle 20 has a source of liquid fuel 60 which is provided to the nozzle 20. Compressed air is also provided to the nozzle 20 through a compressed air line 61.

OPERATION

In operation, the igniter 21 is switched on and tip 22 immediately heats to a temperature which will ignite the atomized liquid being emitted from the apex 23 of nozzle 20 under the suction or venturi effect of the compressed air entering line 61 and leaving nozzle 20. The atomized liquid fuel which may be gasoline, jet fuel, waste oil, diesel fuel, heating oil or the like is ignited by the tip 22 of the guide 21 and pass through the centrally located circumferential aperture 31 where combustion takes place within the burner tube 11. Following the ignition of the atomized fuel in the burner tube 11 and the increase in temperature of the burner tube 11 to allow the combustion to be self sustaining, the igniter 21 will terminate operation. The flame rod 32 senses the presence of a flame in the burner tube 11 as is known. In the event no flame is present, the flame rod 32 will immediately act to shut down the burner 10.

The primary air passes radially through the circumferential primary air holes 24 from the atmosphere. It then passes directly to the burner tube 11 as is illustrated by the arrows in FIG. 1. The secondary air passes axially through the secondary air holes 30 on the secondary air injection plate 12 and act to support combustion within the burner tube 11.

Figure 2A:
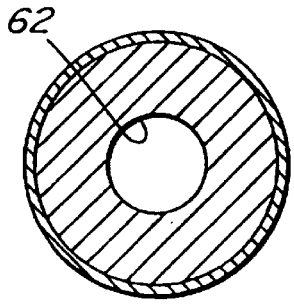
FIGS. 2A and 2B are sectional and end views of the nozzle holder according to the invention taken along IIA and IIB of FIG. 1, respectively.
Figure 2B:
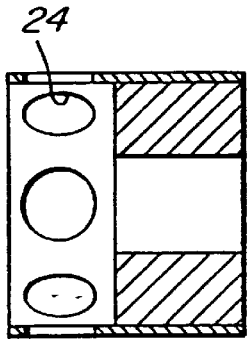

The nozzle holder 14 is shown in more detail in FIGS. 2A and 2B. A hole 62 is machined in the nozzle holder 14 to allow the nozzle 20 (FIG. 1) to be held by the nozzle holder 14. The primary air holes 24 are located about the circumference of the nozzle holder 14 and are used to allow primary air to radially enter into the nozzle holder 14 and, thence, to pass directly to the burner tube 11.

Figure 4A:
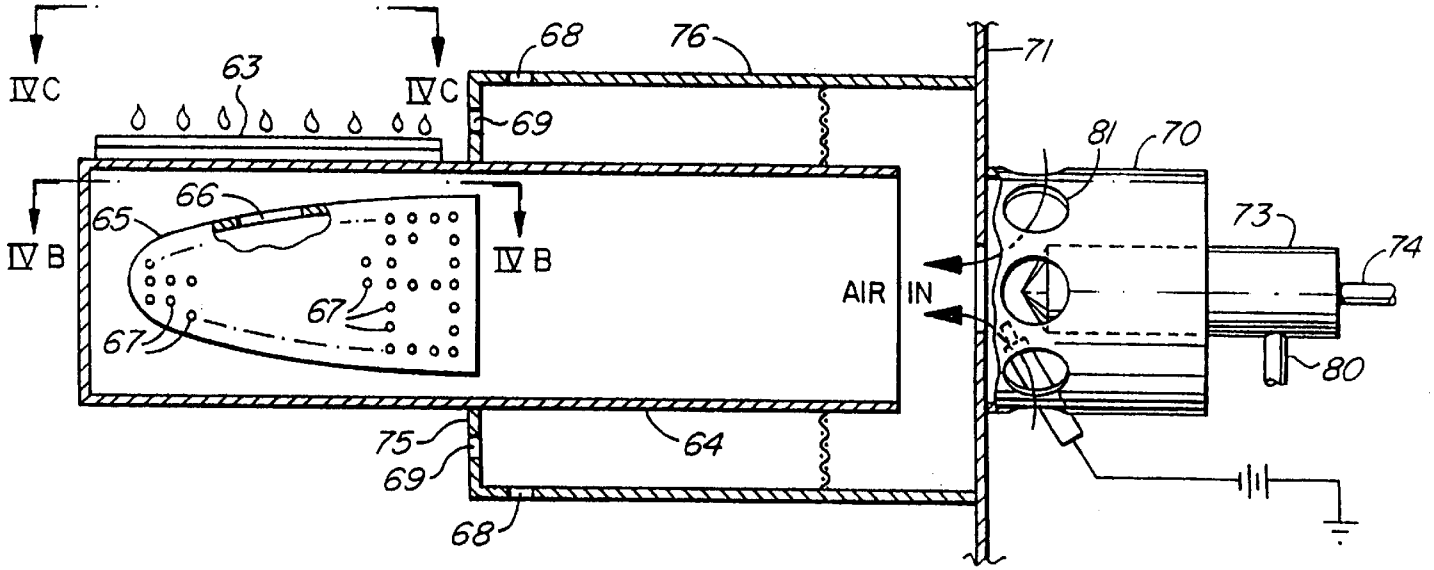
FIG. 4A is a view of the burner according to the invention utilizing a rectangular flame grid and baffle in a furnace or oven heating application.
Figure 4C:
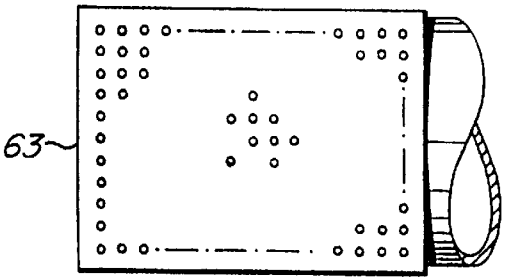
FIG. 4C is a plan view of the rectangular flame grid of the burner according to FIG. 4A.
Figure 4B:
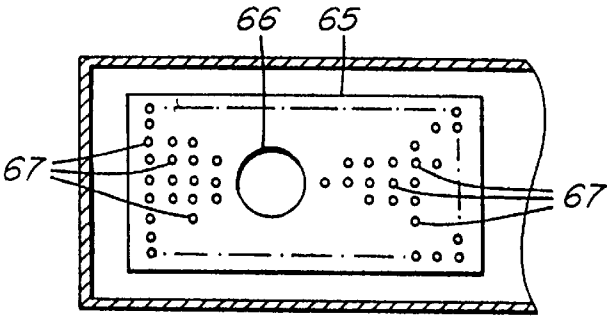
FIG. 4B is a view of the baffle within the burner tube taken along IVB—IVB of FIG. 4A.

A further embodiment of an apparatus with which the burner according to the invention is used is illustrated in FIGS. 4A, 4B and 4C. This embodiment is used, for example, where it is desired to heat an oven such as a stove in a field kitchen as might be used by the military and the like. In this case, the air injection plate 71 will have no secondary holes surrounding the nozzle holder 70 and the burner tube 64 will be located a distance away from the air injection plate 71 as is illustrated. A rectangular or square flame grid 63 faces upwardly and is connected to one end of the burner tube 64. A U-shaped baffle 65 is positioned within the burner tube 64 so that the fuel passes through the baffle 65 on the way to the rectangular grid 63. The baffle 65 has a centrally located pilot hole 66 and a plurality of holes 67 to allow passage of the fuel to the grid 63. The nozzle holder 70 is mounted directly to the injection plate 71 and, upon the tip of the igniter 72 igniting the atomized fuel being ejected from the nozzle 73 under the influence of air being provided through the compressed air line 74 and the liquid fuel being provided through fuel line 80, primary air enters the primary air holes 81 and passes directly to the burner tube 64 to support combustion on flame grid 63. It will be particularly noted that no secondary air holes are provided in the injection plate 71 because the combustion is not taking place within the burner tube 64 but, rather, on the rectangular flame grid 63. However, secondary air intake holes 68, 69 are located in the jacket 76 surrounding the burner tube 64 about the outside circumference of the jacket 76 and the circumference of the end 75 of the jacket 76, respectively.

Figure 3:
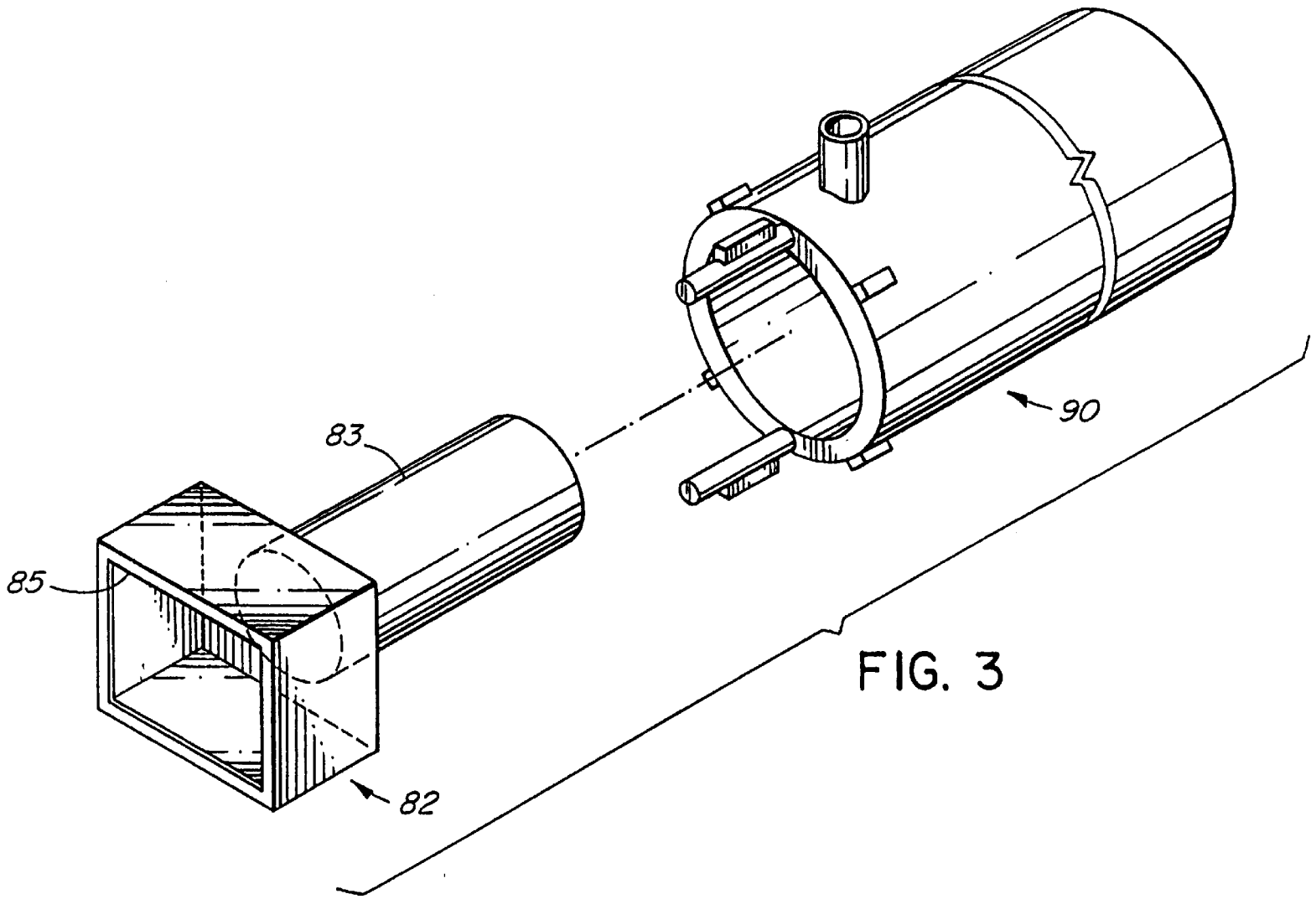
FIG. 3 is an exploded view of several of the operating components of a hot water heater or heat exchanger into one end of which is inserted a burner according to FIG. 1.

A further embodiment of the invention is shown in FIG. 3 which illustrates several operating components of a hot water heater. The burner according to the invention as illustrated in FIG. 1 is inserted directly into the end 85 of the housing generally shown at 82. The burner tube 11 (FIG. 1) extends into cylinder 83 and cylinder 83, in turn, extends into the water jacket generally illustrated at 84.

In operation, and upon initial combustion of the atomized fuel within burner tube 11, the cylinder 83 will be heated. Cylinder 83 will provide heat to the water jacket 90 and the water will be heated.

Instead of a flame rod 32, a photocell could be used which senses the presence or absence of a flame in the burner tube 11.

Figure 5:
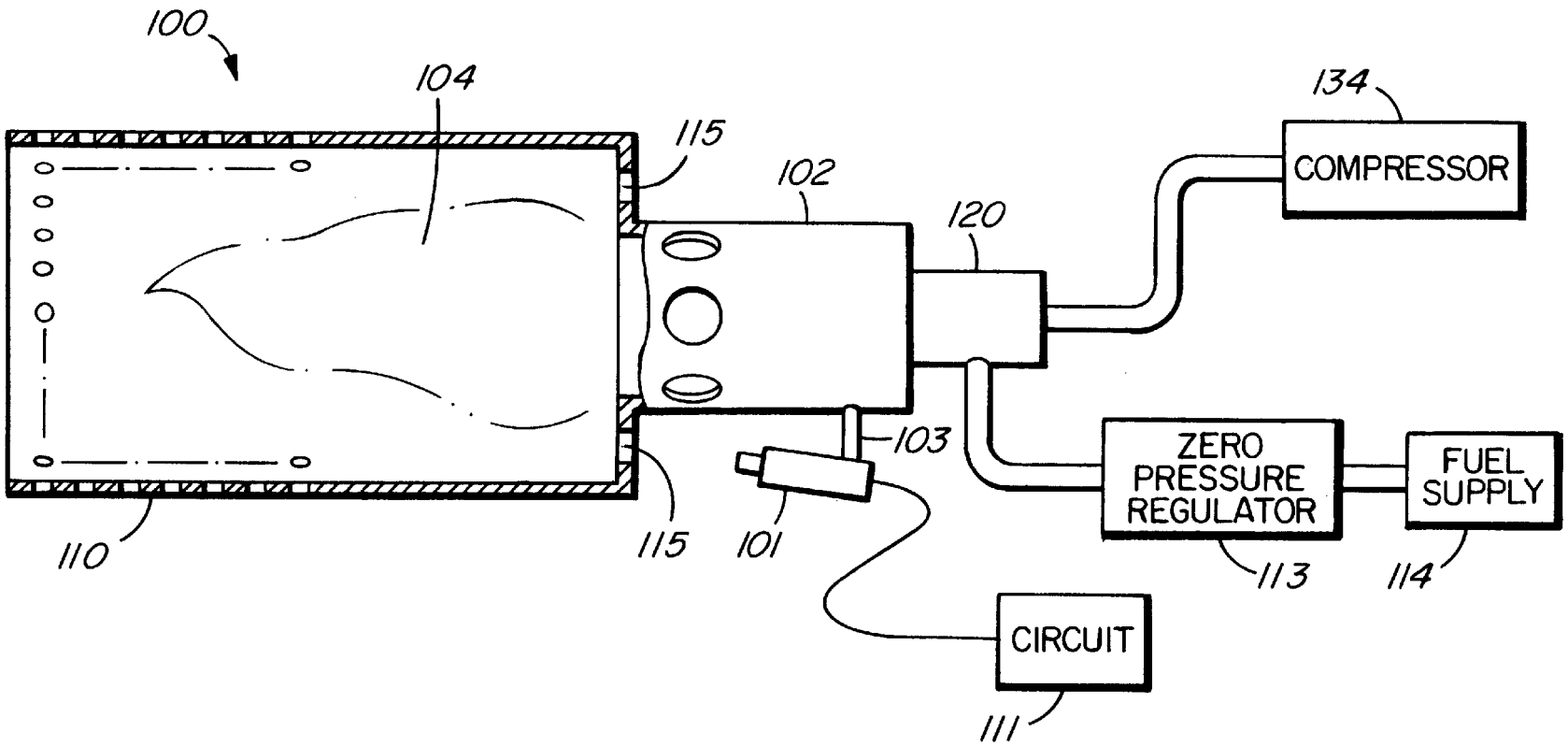
FIG. 5 is a diagrammatic side view of the burner of FIG. 1 and further illustrating a photocell for monitoring the flickering flame within the burner and a zero pressure regulator to regulate the fuel supplied to the burner.

Yet a further embodiment of the invention is illustrated in FIG. 5 which illustrates a burner generally illustrated at 100 similar to burner 10 of FIG. 1. This burner 100, however, has a photocell 101 connected to the nozzle holder 102 by a bracket 103. The photocell 101 monitors the presence of the flame 104 within the burner tube 110 which is seen by the photocell 101 through openings 111 which extend circumferentially around the nozzle holder 102 within the burner tube 110 as is illustrated.

The photocell 101, however, used in prior art devices as a flame sensor is utilised to monitor the presence or absence of a flame 104. Thus, either an off or on signal was provided. If the flame was not present, the photocell would so indicate and the fuel and air supply to the nozzle would each be terminated. However, if the photocell failed, the signal emitted was that for the presence of a flame and the sensor would fail to detect the failure. Thus, the air and fuel supply would continue and there would be an oil buildup in the combustion chamber. This can be a safety hazard, can cause unclean burning when the burner is relighted and is messy to clean up.

Figure 8A:
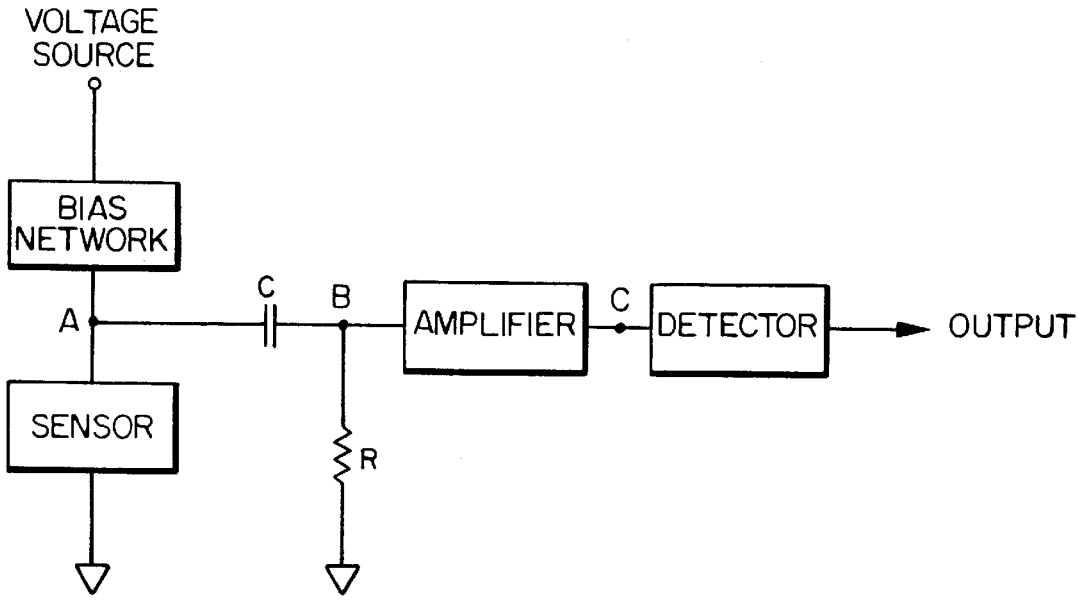
FIG. 8A illustrates the circuit used with the photocell of FIG. 5 to monitor the flickering of the flame of the burner of FIG. 1.
Figure 8A:
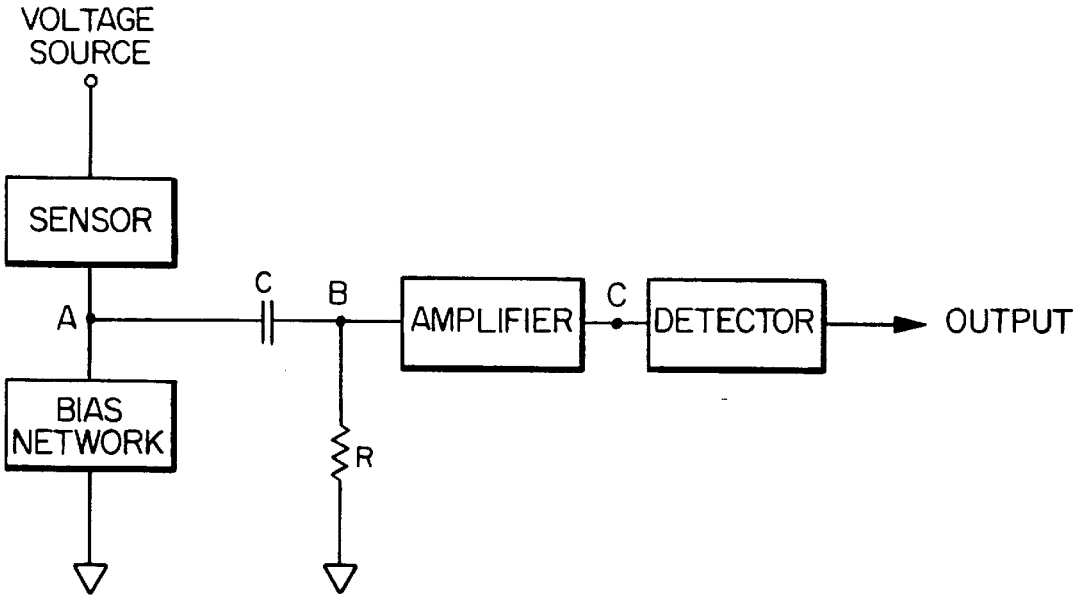
Figure 8B:
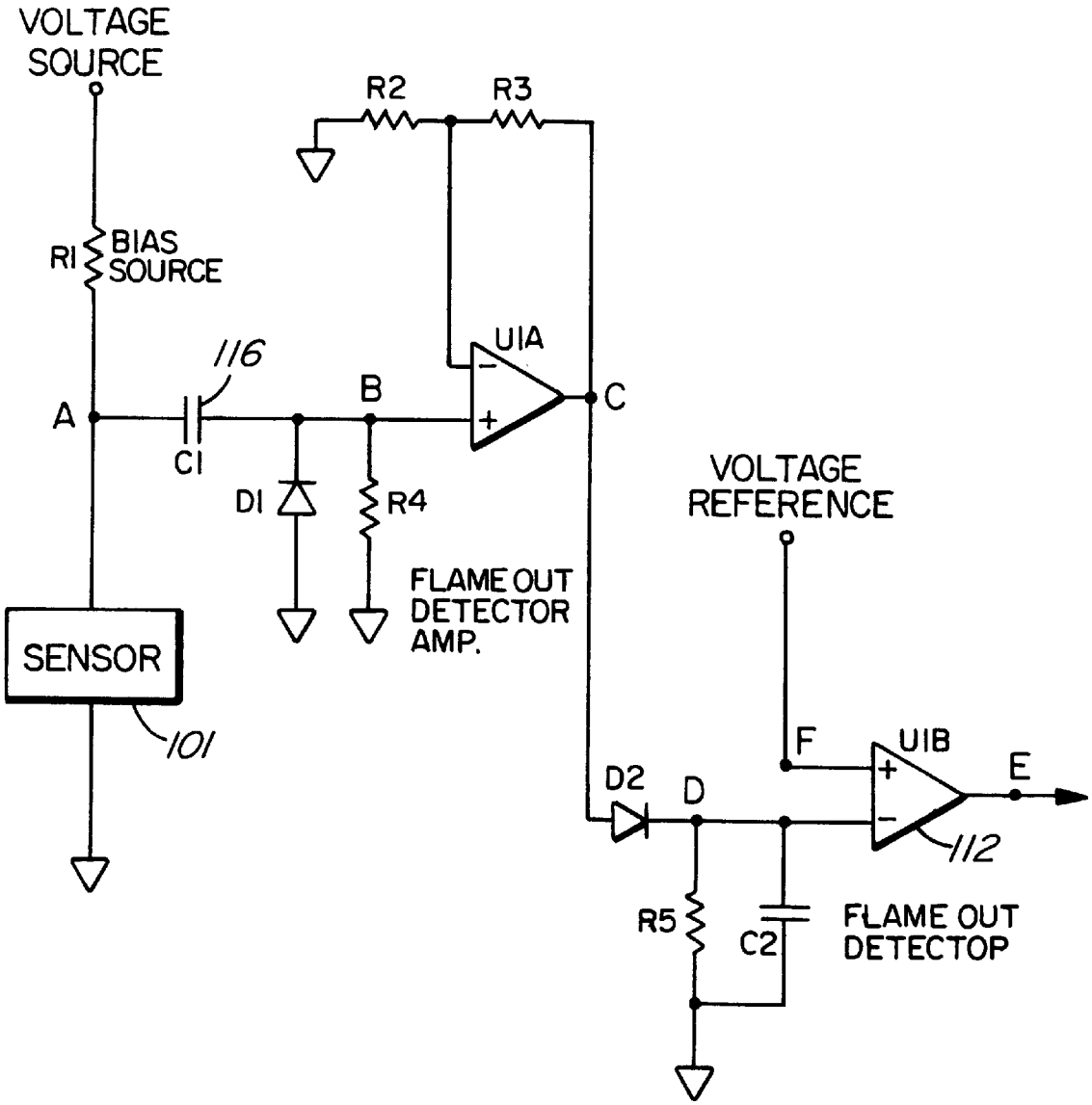
FIG. 8B is a schematic similar to that of FIG. 8A again illustrating the circuit in greater detail which is used with the photocell of FIG. 5 in monitoring the flickering flame.

The photocell 101 according to the present invention utilises a circuit illustrated diagrammatically at 111 in FIG. 5 and illustrated in greater detail in FIGS. 8A and 8B. The circuit 111 allows the photocell 101 to monitor the flickering of the flame 104 within the burner tube 110 through open area 115. The circuit utilises a photocell 101 which is a relatively fast sensor as opposed, for example, to a thermocouple, thermistor or photoresistive cell. A flame rod and phototransistor are also contemplated to be useful for this application. The sensor will have a response rate sufficient to detect the "flicker" of a flame.

The signal from the photocell 101 is then passed through a DC blocking capacitor 116 (FIG. 8B) of the circuit 111 wherein the AC signal riding on a DC level is left and the DC component of the signal is removed such that only the AC component of the signal remains. The sensor 101 receives its DC bias through resistor R1. In normal operation, this results in an average DC voltage at "A" of anything from 2 volts to 6 volts DC with a voltage source of 8 volts. It is contemplated that the bias source R1 may be conveniently replaced by a constant voltage source or constant current diode.

By using a high speed detector, in this case a photo transistor used in the photoconductive mode, at point "A" in FIGS. 8A and 8B, there will be an AC voltage of approximately 1 volt peak to peak. In practise, this varies from about 0.5 volts to 3 volts at random. This is a variability in flame brightness commonly known at the flame "flicker".

The AC component of the signal is passed through the capacitor C1 to point B. At this point, the DC part of the signal is substantially removed. The AC signal will vary, on average, from about +0.5 to −0.5 volts. If the signal goes to a higher level than −0.6 volts, the amplifier U1A may be damaged. Therefore, a diode D1 is included to protect the amplifier when it is operating on a single supply voltage.

The AC signal is then amplified by amplifier U1A. When the signal at "C" exceeds 0.6 volts, the voltage at point "D" begins to rise. When this voltage exceeds the Voltage Reference at "F", the output of the detector, "E" changes state and the circuit supplies a signal to other circuitry giving an indication of flame present.

Since the flame is flickering, the voltage at "C" is not constant but, rather, it rises and falls. Therefore, it is desirable that the signal at "E" only indicate "no flame" when the AC signal has stopped for several seconds. Therefore, the signal at "D" is held by capacitor C2 acting as an energy storage device. This reverse blocking is done by D2. The voltage at "D" only rises when the voltage at point "C" exceeds the voltage at "D" by 0.6 volts. Otherwise, the voltage at "D" is held.

To allow the sensor to detect a loss of signal at points "A", "B" and "C", the voltage stored by C2 at "D" is discharged by R5. If the AC signal stops, the charge on C2 will be drained away by R5 in several seconds, causing the detector, U1B, to indicate a loss of flame or other fault in the burner.

A regulated fuel supply is required. Conveniently, a zero pressure regulator 113 is used with the burner 100 of FIG. 5 and is interposed between the fuel supply 114 and the nozzle 120. The zero pressure regulator 113 acts as a valve to initiate or terminate fuel flow which operates similar to a solenoid valve but which eliminates any electrical connection between a compressor and the solenoid. The zero pressure regulator 113 depends on the venturi action of the nozzle to create a vacuum which allows the regulator 113 to open and admit fuel to the nozzle.

Figure 6:
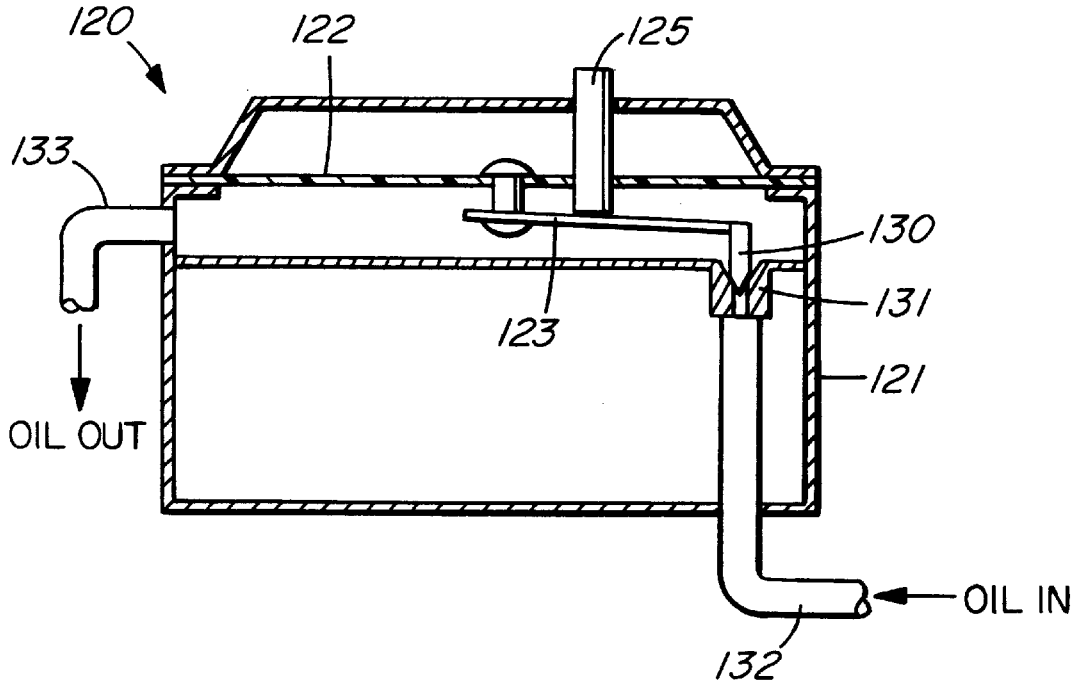
FIG. 6 is a diagrammatic side partial cutaway view in greater detail illustrating the zero pressure regulator of FIG. 5.

The zero pressure regulator according to the invention is illustrated generally at 120 in FIG. 6. It comprises, generally, a housing 121 with a diaphragm 122 located within the housing 121. A lever arm 123 is mounted to the diaphragm 122 by a rivet 124 and moves about support 125. A needle 130 is mounted on the end of the lever arm 123 as illustrated. Needle 130 is reciprocal within seat 131.

In operation, the venturi action of the nozzle will create a vacuum within the regulator 120 and the lever arm 123 will rotate about support 125 thereby allowing the needle 130 to move away from seat 131. Fuel will thereby enter the regulator 120 from the fuel supply line 132 and will exit the regulator 120 from the outlet line 133. If the venturi action of the nozzle is greater that such action described above, more fuel will be allowed to pass through regulator 120 and if less venturi action is present, less fuel will be allowed to pass. This action is independent and relies on the quantity of air being supplied to the nozzle by the compressor air supply 134 (FIG. 5).

Figure 7A:
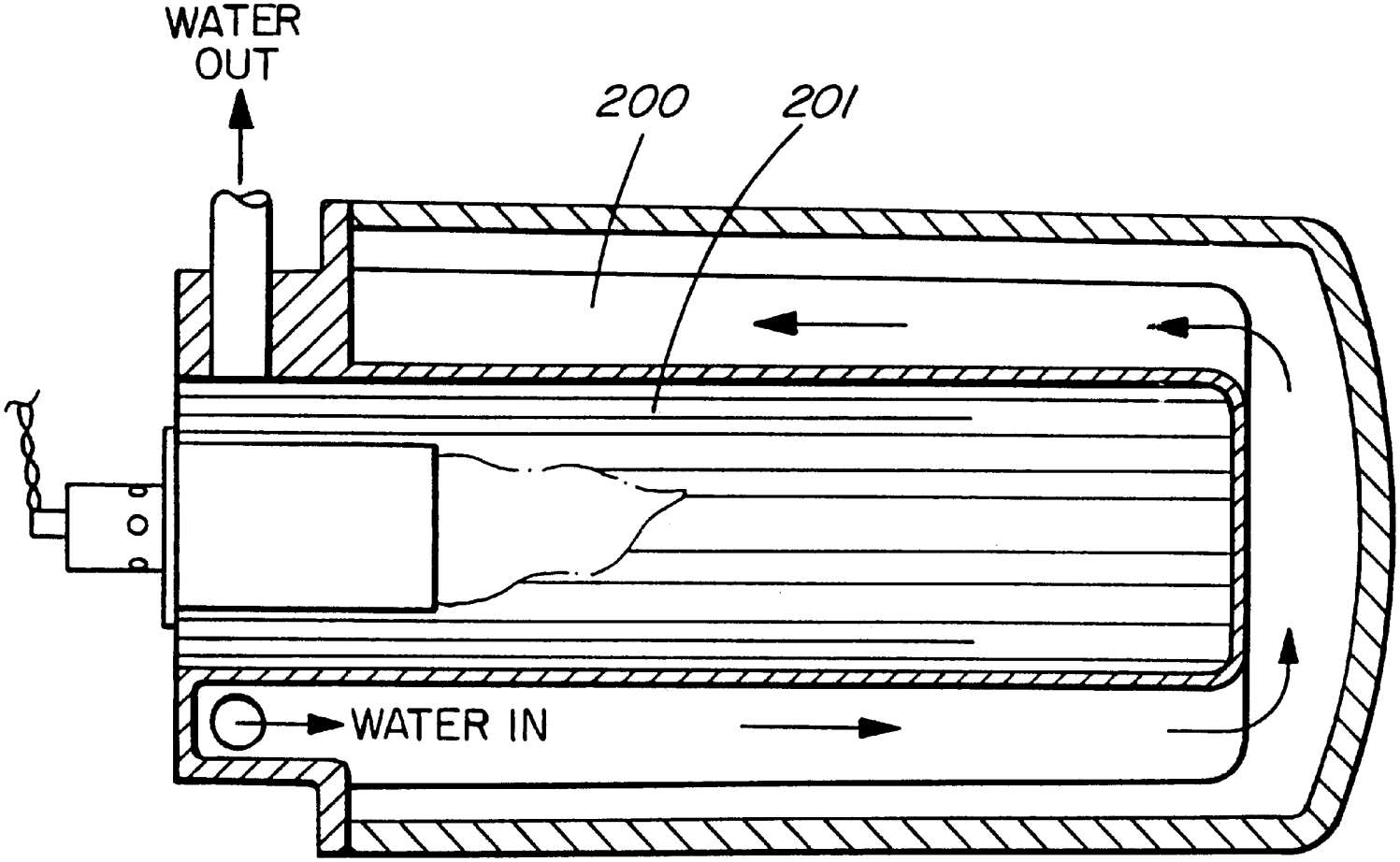
FIG. 7A is a diagrammatic side view of a fluted cast aluminum heat exchanger used with the burner of FIG. 1.
Figure 7B:
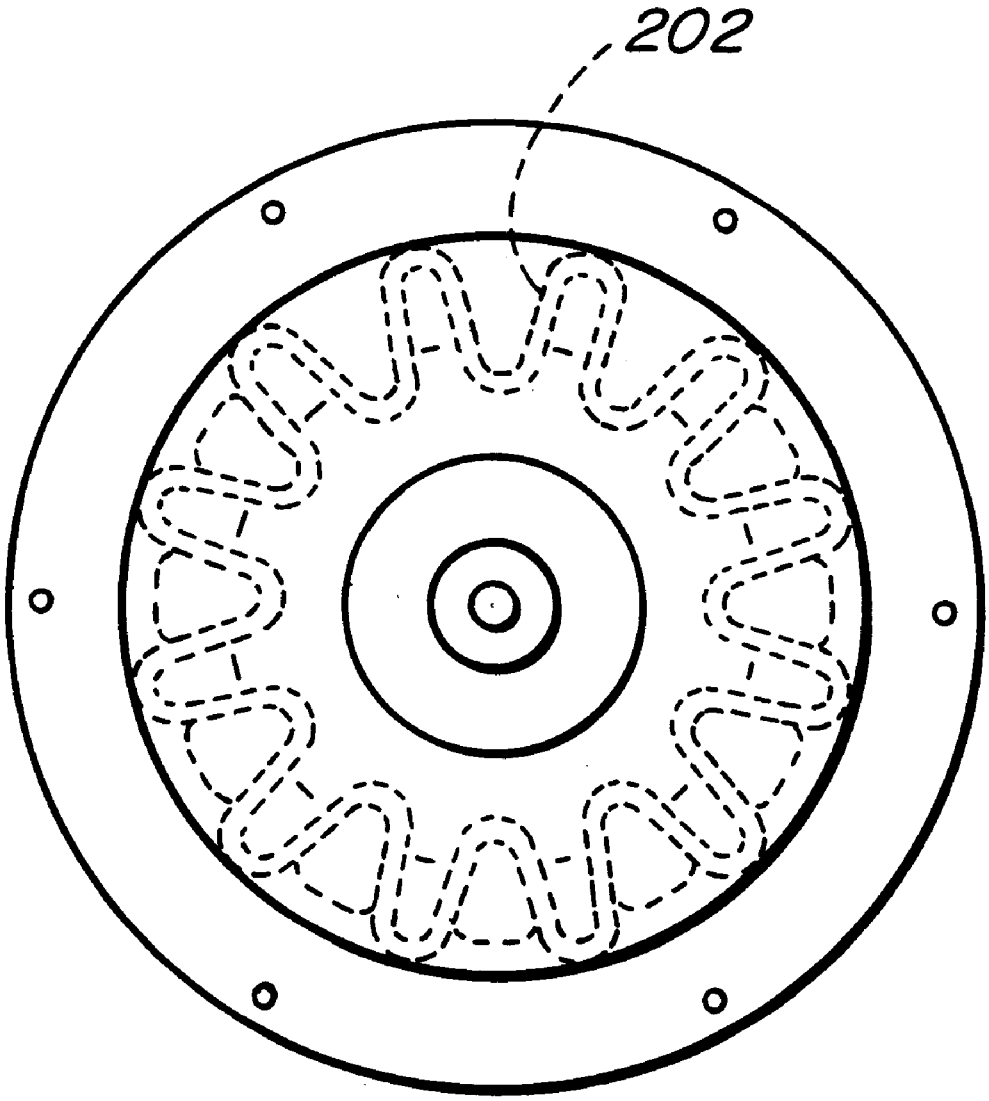
FIG. 7B is an end view of the casting of FIG. 7A.

Reference is now made to FIG. 7A wherein the heat exchanger illustrated is generally illustrated at 200. The heat exchanger 200 surrounds the burner 201 and is cast aluminum made conveniently made by sand casting although other casting techniques could also be utilised. The heat exchanger 200 comprises a plurality of hat sections or flutes 202 which are useful since they expose an increased outer surface area to contact by the water flowing through the heat exchanger 200 and an increased inner area to the heat provided by the burner 201, as opposed, for example, to fins.

It is desirable to have cast rather than extruded aluminum. This is so because the number of parts can be reduced and also because the cast surface tends to slow the gases from the burner 201 which allows more resident time for the gases within the burner and contributes to enhanced heat transfer.

While specific embodiments have been described, such descriptions should be taken as illustrative of the invention only and not as limiting its scope. Many modifications will readily occur to those skilled in the art to which the invention relates and, therefore, the scope of the invention should properly be construed in accordance with the accompanying claims.

What is claimed is:

1. A burner system comprising a burner having an air aspirated nozzle, a compressor for supplying compressed air to said air aspirated nozzle, a fuel supply for supplying fuel to said air aspirated nozzle, a regulator for regulating the amount of fuel provided to said air aspirated nozzle, and a heat exchanger surrounding said burner, said heat exchanger having a plurality of flutes surrounding said burner, said flutes having an inside and outside surface area, a water supply to supply water under pressure to said heat exchanger, and to circulate said water through said heat exchanger, said inside area of said flutes being exposed to the heat produced by said burner and said outside area of said flutes being exposed to the water circulated through said heat exchanger.

2. A burner system as in claim 1 wherein said heat exchanger is made from cast aluminum.

3. A burner system as in claim 2 wherein said heat exchanger is sand cast aluminum.

4. A burner system as in claim 1 wherein said regulator is a zero pressure regulator.

5. A burner system as in claim 1 and further comprising a flame monitoring device to monitor the flickering of a flame present in said burner.

6. A burner system as in claim 5 wherein said flame monitoring device is a flame rod or a photocell.

7. A burner system as in claim 6 wherein said flame monitoring device has a circuit associated therewith to monitor the AC signal produced by said photocell.

8. A burner system as in claim 7 wherein said circuit associated with said flame monitoring device includes a capacitor to substantially remove the DC signal produced by said photocell.

9. A burner system as in claim 8 wherein said circuit associated with said flame monitoring device further includes apparatus to terminate the operation of said compressor.

* * * * *